US005143236A

United States Patent [19]

Gueret

[11] Patent Number: 5,143,236

[45] Date of Patent: Sep. 1, 1992

[54] PACKAGING UNIT FOR IMPROVING PRESERVATION OF THE PRODUCT DURING STORAGE

[75] Inventor: Jean-Louis H. Gueret, Paris, France

[73] Assignee: L'Oreal, Paris, France

[21] Appl. No.: 715,801

[22] Filed: Jun. 14, 1991

[30] Foreign Application Priority Data

Jun. 15, 1990 [FR] France ..... 90 07496

[51] Int. Cl.[5] ..... B65D 47/36

[52] U.S. Cl. ..... 215/311; 215/247; 215/249; 215/251; 215/276; 53/105; 53/320

[58] Field of Search ..... 53/432, 490, 489, 405, 53/408, 403, 402, 401, 105, 320, 510; 215/307, 311, 330, DIG. 3, 247, 248, 249, 276

[56] References Cited

U.S. PATENT DOCUMENTS 2,364,126 12/1944 Cantor et al. ..... 215/43
2,436,291 2/1948 Daniel ..... 215/307 X
3,179,276 4/1965 Safianoff ..... 215/307
3,318,496 5/1967 Ayotte et al. ..... 215/307 X
4,341,319 7/1982 Ogasawara ..... 215/307
4,364,485 12/1982 Knapp ..... 53/53 X
4,487,326 12/1984 Uhlig ..... 215/307
4,976,894 12/1990 Robinson ..... 215/247 X

*Primary Examiner*—James F. Coan
*Attorney, Agent, or Firm*—Cushman, Darby & Cushman

[57] ABSTRACT

According to this process, the container (2) is filled, and after filling a capsule (6) carrying a valve is fixed in a sealed manner to the neck (21) of the bottle (2), said valve consisting of a membrane (5) of elastomeric material of thickness such that that valve can become sealed again by elastic recall after having undergone aspiration in order to create a reduced pressure and/or the introduction of unreactive gas, the capsule (6) and the valve (5) remaining on the container (2) and maintaining the seal of the container (2) during storage. A top cap (4) may receive the valve (5) and contribute to sealing. The invention also relates to a packaging unit for the implementation of this process.

8 Claims, 2 Drawing Sheets

PACKAGING UNIT FOR IMPROVING PRESERVATION OF THE PRODUCT DURING STORAGE

BACKGROUND OF THE INVENTION

This invention relates to a process for packaging a product in a container for improved preservation of the product during storage by reducing pressure in the container enclosing the product and/or by introducing into the container a gas which is unreactive with respect to the packaged product. This process is particularly suitable for use on packaging lines.

It is known, inter alia from U.S. Pat. No. 2,364,126, that the preservation of products during storage can be improved by reducing pressure in the container containing them by aspiration, or by replacing the air in the container by a gas which is unreactive with respect to the stored product. The term "unreactive gas" refers to a gas that cannot react chemically with the preserved product and does not contain microorganisms capable of damaging the preserved product. In practice, the unreactive gas is usually nitrogen. Unfortunately, the aspiration or injection of unreactive gas is generally effected by means of a hypodermic needle, the small section of which limits the gaseous flow and consequently increases the time required for these operations on the packaging line.

The improvement of the preservation of products during storage has the advantage of completely or partially preventing the necessity to add preservatives to these products which may have a harmful effect on the user, e.g. an irritant or allergenic reaction in the case of cosmetics.

SUMMARY OF THE INVENTION

This invention relates firstly to a process for packaging a product in a container for improved preservation of the product during storage by reducing pressure in the container by aspiration and/or by introducing therein a gas which is unreactive with respect to the stored product. Once the container has been filled with the product via a neck zone, a capsule is fixed to the said neck zone in a sealed manner by means which establish a pressure lower than atmospheric pressure by aspiration and/or by having an unreactive gas introduced by injection. The capsule remains on the container and then maintains the seal of the container during storage, characterized in that the capsule is associated with a valve consisting of a flexible elastic membrane provided with at least one opening for receiving a member connected to aspiration means for reducing pressure and/or injection means for the introduction of an unreactive gas to the valve. The pressure is reduced and/or the unreactive gas is introduced into the container with the aid of the said member by means of the valve, the opening and closure of the said valve being effected by deformation of the elastic membrane, and that finally the member is removed.

In a first embodiment, the valve used consists of a relatively thick elastic membrane comprising in its central zone an opening formed by at least one slot, the membrane being held on the neck zone via its edges by virtue of the capsule with which it cooperates. Aspiration is ensured by applying the end of a tube to the central zone of the membrane, the bearing perimeter completely surrounding the opening, and by connecting the tube to a source of reduced pressure, thereby ensuring deformation of the edges of the opening under the influence of the difference in pressure and the communication between the interior of the container and the source of reduced pressure. In this embodiment, the injection of unreactive gas is ensured by mechanical deformation of the elastic membrane in its central zone by the application of a nozzle, the conduit of which carries the unreactive gas under pressure at right angles with the opening, the lips of which are moved away from one another by the application of the nozzle.

In a second embodiment, the valve used comprises a plurality of openings. The flexible membrane of the valve cooperates with a seat at right angles with its openings, and the member connected to the aspiration means and/or injection means comprises a bell. In order to reduce pressure or to introduce the unreactive gas, the bell is applied to the flexible membrane over a perimeter surrounding all of the openings.

According to the invention, it is possible either to reduce pressure in the container or to introduce an unreactive gas by bleeding the air contained in the container. However, aspiration is preferred initially to obtain a reduced pressure in the container, the container then being returned to atmospheric pressure by the introduction of an unreactive gas.

Finally, a top cap is preferably fixed to the capsule, covering the valve. According to the invention, the top cap may have a simply aesthetic function, serving to cover and conceal the capsule. However, it may also cooperate with the valve in order to maintain the seal of the container during storage. The capsule is preferably covered with a top cap comprising elements which prevent the deformation of the flexible membrane so as to keep the valve in the closed position during storage and, consequently, to ensure sealing of the container. It should be noted that, in certain cases, it is possible not to fix a top cap, e.g. if the container is rigid, if the product does not move around or if the unreactive gas is in the container under atmospheric pressure. However, in the majority of cases, it is necessary to fix a top cap in order to prevent the flexible membrane from deforming at the slightest excess pressure in the interior of the container and causing opening of the valve. Moreover, the top cap may comprise in itself sealing means disposed around the opening zone of the valve.

This invention relates secondly to a packaging unit comprising a container enclosing a product, and to a neck zone to which there is fixed a capsule associated with a valve of means by which a pressure is reduced and/or an unreactive gas is introduced into the container. According to the invention, this unit is characterised in that the valve consists of a flexible elastic membrane in the form of a cylindrical cap comprising an edge and a base, at least one opening being formed in the membrane, wherein said valve can remain closed by virtue of the inherent elasticity of the membrane and can open by the action of an aspiration and/or injection member over the base of the membrane.

According to the invention, the container may be of any design and may be, e.g. in the form of a bottle, pot or tube. The neck zone forms the part to which the capsule is fixed, irrespective of the shape and dimensions of the transverse section of this part relative to the container and irrespective of the method of pressure fixing used.

The neck zone carrying the valve/capsule assembly may be the zone used for dispensing the product. If not, the product is dispensed via a second neck disposed, in particular, on the shoulder of the container, or on the part of the container opposite the neck zone carrying the valve/capsule assembly.

A top cap is preferably fixed to the capsule, e.g. by means of snap engagement, so as to cover said capsule and the valve it carries. In this case, the outer wall of the capsule and/or the inner wall of the top cap is (are) preferably provided with means for preventing the rotation of the top cap relative to the capsule, in particular fins or grooves.

In a first embodiment, the valve consists of a relatively thick elastic membrane comprising in its central zone an opening formed by at least one slot, the membrane being held on the neck zone via its edges by virtue of the capsule with which it cooperates.

According to this first embodiment, the capsule may comprise a membrane support consisting of an inner collar substantially perpendicular to the longitudinal axis of the neck, the elastic membrane being fixed to the collar. The elastic membrane may be fixed to the side of the collar situated at the container side, or to the side of the collar directed towards the exterior, or even to the inner edge of the collar at the same level as the latter. In the first case, the membrane is mounted via the interior of the capsule and it ensures sealing between the collar and the rim of the neck of the container. In the second case, the membrane is mounted via the exterior of the capsule. It can then be fixed by crimping with the aid of a metal ring, or by shrinking by deformation of plastic material, or even by welding or gluing. In the third case, the membrane may be fixed by means of snap engagement, or possibly welding, to the edge of the collar. The inner edge of the collar, particularly in the case of a membrane having thick edges, may lock into a peripheral groove formed in the lateral wall of the membrane.

In all of the variants of this first embodiment, the capsule may advantageously be covered by a top cap comprising an element capable of reinforcing the seal. According to the invention, the element capable of reinforcing the seal may consist of a projection of the top cap resting against the zone corresponding to the slot (or slots) of the opening of the membrane. It may also consist of an annular rib of the top cap cooperating with an annular groove formed in the membrane around the opening.

In a second embodiment, the flexible membrane is carried by the capsule and the edge of the cylindrical cap forming the flexible membrane is connected to the base via a lateral skirt, the membrane comprising a plurality of openings disposed in the connecting zone between the base and the lateral skirt and at right angles with the end of a rigid skirt integral with the capsule, an annular projection carried by the base resting against the inner face of the rigid skirt, the end of the said rigid skirt thereby being gripped between the annular projection and the lateral skirt of the flexible membrane.

In this second embodiment, the elastic membrane is generally thinner than the first embodiment. The opening and closure of the valve are effected by deformation of the elastic membrane, so that it is possible to move the flexible skirt away from the rigid skirt forming the seat or to bring them into contact with one another. The flexible skirt of the membrane is in sealed contact with the skirt forming the seat in the absence of any deformation of the central zone of the elastic membrane and moves away from the skirt forming the seat when there is deformation of the zone under the influence of an exterior negative pressure. Between the fixing zone of the capsule to the neck and the end of the rigid skirt there may be provided, on the one hand, a perforated wall ensuring both the rigidity of the rigid skirt and the passage of the product to be distributed, and, on the other hand, means ensuring sealing between the capsule and the container. The fixing of the elastic membrane to the capsule is preferably effected by means of welding, snap engagement or gluing of the edge of the cylindrical ca forming the elastic membrane to the zone of the capsule surrounding the rigid skirt.

According to this second embodiment, a top cap is preferably fixed to the capsule so as to cover it, this top cap comprising means for holding the elastic membrane in the closed position. This means consists, e.g. of a flange situated on the inner wall of the top cap which presses against the elastic membrane substantially at right angles with the annular projection of the latter and holds the lateral skirt of the elastic membrane against the rigid skirt forming the seat.

BRIEF DESCRIPTION OF THE DRAWINGS

The object of the invention will be more readily understood from the following description of several embodiments given purely by way of non-limiting examples and illustrated in the accompanying drawings, in which:

FIGS. 1 & 2 are diagrams showing the operation of a unit according to the first embodiment of the invention, FIG. 1 showing the elastic membrane during the phase of aspiration of the atmosphere into the container, while FIG. 2 shows the phase of injection of an unreactive gas into the internal atmosphere of the said container;

DESCRIPTION OF THE DETAILED EMBODIMENT

Figure 2:
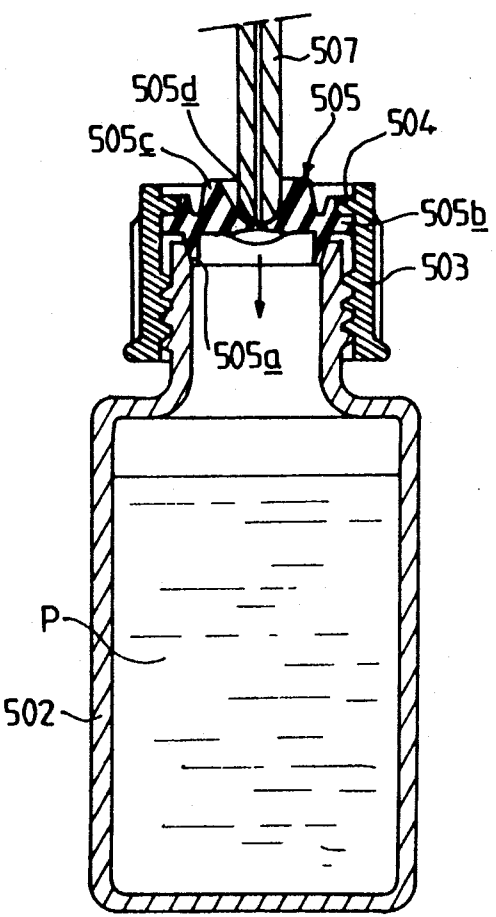
Figure 1:
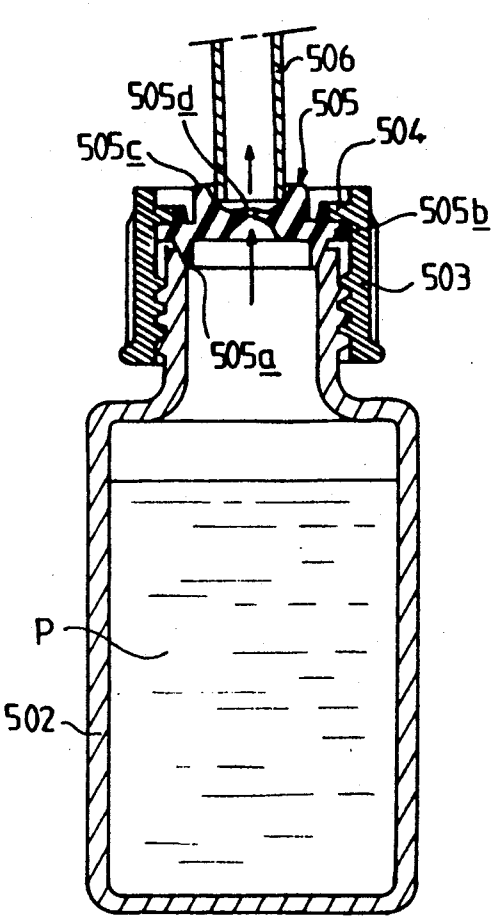

FIGS. 1 and 2 show the operation of the valve of a unit according to the first embodiment of the invention in schematic form. The neck of a bottle 502 is provided with a screw capsule 503. The capsule 503 comprises in its upper part, i.e. the part opposite the thread for fixing to the bottle 502, a radial collar 504 which presses an elastic membrane 505 against the edges of the neck. The membrane 505 is in the form of a cylindrical cap. It comprises a skirt 505*a*, via which it is engaged in the neck of the bottle 502, an annular edge 505*b* which is disposed below the collar 504 and allows the elastic membrane 505 to be held against the neck, and an annular flange 505*c* forming a partition between the edge 505*b* and the central zone 505*d* of the membrane.

The flexible elastic membrane 505 comprises in its central zone and on its two faces dished recesses for reducing the thickness of the part of the membrane 505 situated along the axis of the neck of the bottle 502. In other words, the membrane 505 has a relatively large yet varying thickness over its entire periphery, but is much finer along the axis of the neck. A slot is formed in the membrane at this point. The two edges of the slot are contiguous and the two edges are held against one another by the inherent elasticity of the material of the membrane 505. This slot forms the opening of the valve formed by the membrane 505.

In FIG. 1, it will be seen that a tube 506 has been placed on the membrane 505, said tube being connected to aspiration means. The lower end of this tube rests against the peripheral zone of the annular flange 505*c* and the negative pressure existing in the tube 506 causes deformation of the lips of the slot, thereby allowing for aspiration of the atmosphere contained in the bottle 502 above the product placed in position beforehand. It is possible in this manner to reduce pressure in the bottle.

In addition, however, FIG. 2 shows that it is also possible to place an unreactive gas in the bottle 502. To this end, pressure is applied to the central zone of the membrane 505 by means of a nozzle 507, the axial conduit of which allows for the injection of an unreactive gas under pressure, e.g. nitrogen. Considerable downwardly directed mechanical stress is applied to the nozzle 507 so as to open the lips of the slot formed in the central part 505*d* of the membrane 505. This opening of the lips allows for the injection of the unreactive gas. When the mechanical stress exerted via the nozzle 507 is suppressed, the membrane 505 returns by elasticity to its initial position, i.e. into a position in which the lips of the slot are contiguous.

FIGS. 3 to 6 show variants relating to the implementation of the first embodiment of the invention.

Figure 3:
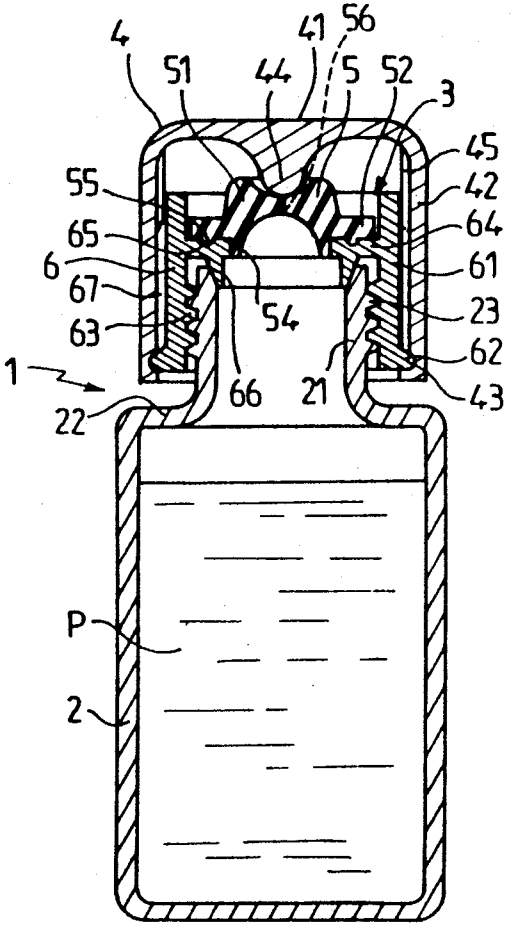
FIG. 3 is an axial section of a unit according to the first embodiment of the invention in the storage position and provided with a top cap.

The unit ready for storage shown in FIG. 3 is designated by the reference numeral 1. It comprises a bottle 2 to which there is fixed a head 3 to which there is fixed, in turn, a top cap 4.

The bottle 2 is filled with a product P. The bottle 2 is surmounted by a cylindrical neck 21 connected to the body of the bottle by a shoulder 22. The neck 21 is provided with an external screw thread 23.

The head 3 consists of an elastic membrane 5 forming a valve and a capsule 6. The capsule 6 is fixed in a sealed manner to the neck 21 of the bottle 2. It comprises a cylindrical skirt 61 provided in the lower part of its inner wall with an internal screw thread 63 cooperating with the external screw thread 23 of the neck 21 of the bottle 2. When the head 3 is screwed on to the neck 21, the edge situated at the bottle side of the skirt 61 is disposed slightly above the shoulder 22 of the bottle. This edge situated at the bottle side carries an outer locking flange 62. The inner wall of the skirt 61 carries in its upper part, below the upper edge of this skirt 61, a flat annular collar 64 perpendicular to the axis of the neck. This collar 64 forming a support carries on its upper face a circular groove 65 and on its lower face a short sealing skirt 66 having an outer diameter equal, except for the necessary clearance, to the inner diameter of the neck. The outer wall of the skirt 61 is provided with antirotation serrations 67.

The elastomeric membrane 5 forming the valve comprises a thick part 51 generally having the shape of a cylinder having the same axis as the 21, this being convex. The membrane 5 is glued on to the collar 64 of the capsule 6 via an annular part 52 thinner than the part 51 and having a diameter slightly less than the inner diameter of the skirt 61. A cylindrical sealing skirt 54 having an outer diameter equal, except for the necessary clearance, to the inner diameter of the collar 64 of the support 6, is disposed on the lower face of the thick part 51. The lower face of the annular part 52 is provided with a flange 55 which locks into the groove 65 of the collar, the flange 55 and the groove 65 serving to center the membrane 5 at the time of mounting.

A top cap 4 covers the head 3 and consequently the valve 5. It consists of an upper circular face 41, a cylindrical skirt 42 departing from the edge thereof towards the bottle, said cylindrical skirt carrying on its inner wall, just above its free edge, an annular groove 43, the flange 62 of the skirt 61 of the capsule 6 locking therein by means of snap engagement. The inner wall of the skirt 42 of the top cap 4 is provided with antirotation serrations 45. An axial projection 44 which in the storage position comes to rest against the point at which the slot 56 is formed, is disposed under the upper surface 41 of the top cap (indicated by the dotted lines in FIG. 3).

The packaging process is effected as follows. In a first stage, the bottle 2 is filled with the product P. When the bottle is full the head 3 is fixed by screwing the capsule 6 on to the neck 21 of the bottle, the elastomeric membrane 5 having been first glued via its annular part 52 to the capsule 6 by introducing the skirt 54 into the opening of the collar 64 and locking the flange 55 into the groove 65. Aspiration is effected with the aid of a tube 506 in order to reduce pressure in the bottle, and then nitrogen is introduced by injection with the aid of a device 507 until the bottle is returned to atmospheric pressure. As soon as the nozzle 507 is removed, the opening 56 is closed again instantaneously by virtue of the elasticity of the elastomeric material forming the membrane 5. In a third stage, the top cap 4 is placed on the head 3. The top cap 4 snaps on to the flange 62 of the capsule 6 via its groove 43. The projection 44 comes to rest against the membrane 5 at right angles with the opening 56, now closed. It will be seen that as the opening 56 is closed and the projection 44 prevents any risk of deformation of the membrane 5 in this zone, the bottle remains sealed during storage. When a user wishes to open the bottle he rotates the top cap 4 and, by virtue of the interaction of the serrations 67 of the capsule 6 and the serrations 45 of the top cap 4, the head 3 is rotated at the same time. As far as the user is concerned, it appears that the head 3 and the top cap 4 consist of only one piece.

Figure 4:
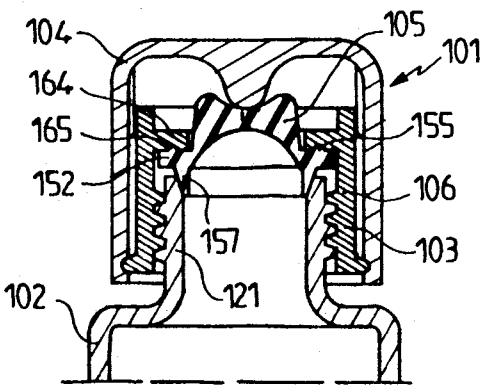

FIG. 4 shows a variation 101 of the unit according to the first embodiment of the invention. This unit comprises a membrane 105 of an elastomeric substance in a head 103. In this unit, the top cap 104 is identical to that of the unit 1 illustrated in FIG. 3. The principal difference consists of the fact that the membrane 105 is fixed by gluing under the collar 164 of the capsule 106. In order to assist with the mounting of the head 103, the collar 164 carries on its face, directed towards the bottle, a groove 165 and the annular part 152 of the membrane 105 carries on its upper face a flange 155, the flange 155 locking into the groove 165. In this case, the membrane 155 carries on the lower face of its annular part a sealing skirt 157 locking into the neck 121 of the bottle 102. In this variant, the membrane 105 is mounted on the capsule 106 via the interior of the latter before the head 103 is fixed to the neck 121 of the bottle 102.

Figure 5:
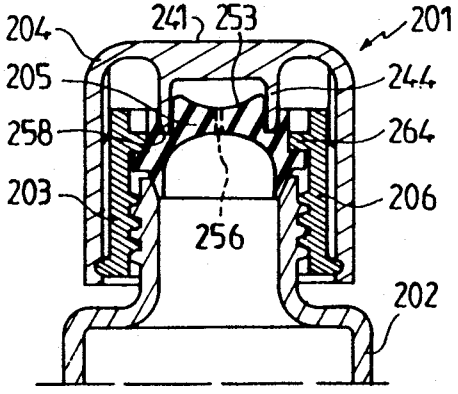

FIG. 5 shows another variation 201 of the unit according to the first embodiment of the invention. In this unit 201, the capsule 206 of the head 203 is identical to that shown in FIG. 4 and the membrane 205 is also fixed to the face on the container side of the collar 264 of the capsule 206. The principal difference consists of the fact that the element of the top cap 204 is capable of reinforcing the seal. A circular rib 244 is formed under the upper face 241 of the top cap 204, said rib cooperating with a circular groove 258 formed on the periphery of the upper dish 253 of the membrane 205 all around the opening 256 formed by the slot having contiguous edges.

Figure 6:
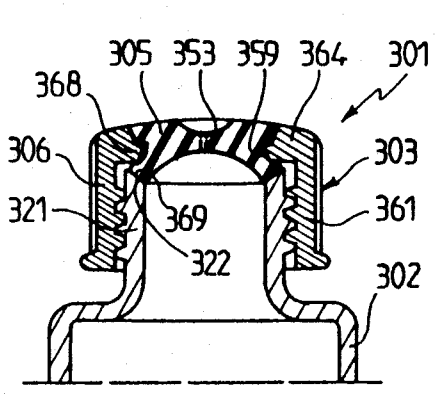
FIGS. 4 to 6 are partial axial sections of three other variants of a unit according to the first embodiment.

FIG. 6 shows another variation 301 of the unit according to the first embodiment of the invention. This unit 301 does not comprise a top cap. The head 303 consists of a capsule 306 and a thick membrane 305. The capsule 306 comprises a cylindrical skirt 361 which is screwed on to the neck 321 of the bottle 302. The end directed towards the exterior of the skirt 361 carries an annular collar 364 perpendicular to the axis of the neck 321. The edge of the collar 364 forms a circular projection 368. The membrane 305 of elastic material has a generally cylindrical shape. It comprises dished upper and lower surfaces 353. The lateral surface of the membrane 305 comprises an annular groove 359 complementary to the projection 368. The upper edge of the neck 321 is chamfered at 322 and the lower edge of the membrane 305 is also chamfered at 369 so that it has a shape complementary to that of the chamfer 322 of the neck 321. The seal is ensured simply by the lips of the slot forming the opening of the valve being gripped elastically against one another. This variant is preferably used with a thick packaged product surmounted by an unreactive gas at atmospheric pressure.

Figure 9:
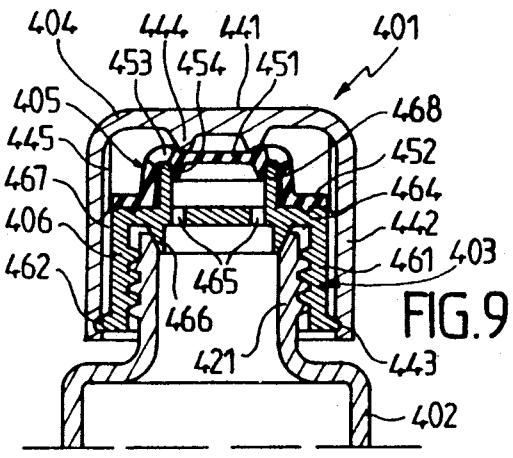
FIG. 9 is a partial axial section of the bottle of FIG. 8 after the fixing of a top cap.
Figure 8:
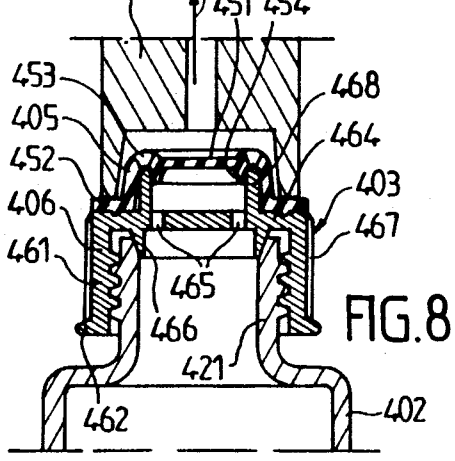
FIG. 8 is a partial axial section of a bottle on which the capsule of FIG. 7 is mounted, during the aspiration process in order to establish a reduced pressure.

FIGS. 8 and 9 show a unit 401 according to the second embodiment of the invention at different stages of the process.

Figure 7:
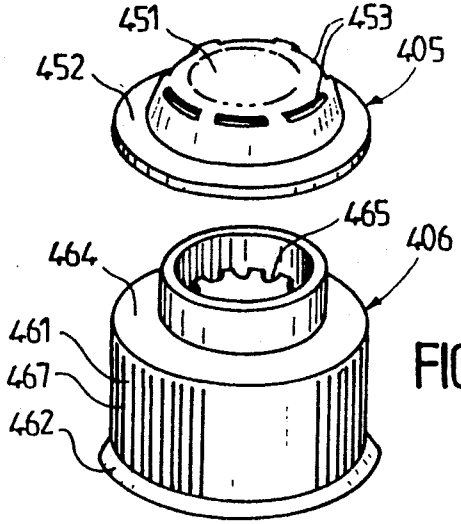
FIG. 7 is an exploded perspective of the capsule of a unit according to the second embodiment, during mounting.

FIG. 9 shows an axial section of the unit 401 ready for storage. This unit 401 consists of a bottle 402, to the neck 421 of which there is screwed a head 403, which is in turn covered by a top cap 404. The head 403 consists of a capsule 406 to which there is fixed by welding a fine elastic membrane 405 forming the valve and cooperating with a seat which forms part of the capsule 406. FIG. 7 is a more detailed view the capsule 406 and the membrane 405 during mounting of the head 403. The capsule 406 consists of a cylindrical skirt 461 having the same axis as the neck 421, which is provided on its inner wall with a screw thread cooperating with an external screw thread of the neck and comprises on its lower edge an outer locking flange 462. The skirt 461 carries in its upper part a circular transverse plate 464. This plate 464 is provided with openings 465 disposed in a circle having as its axis the axis of the neck 421 and opening into this neck 421. It is provided on its face at the bottle side with a sealing skirt 466 in contact with the inner wall of the neck and on its opposite side with a cylindrical skirt 468 which forms a seat for the elastic membrane 405 as will be explained hereinafter. The cylindrical skirt 468 surrounds the openings 465.

The elastic membrane 405 is in the form of a cylindrical cap, which covers the cylindrical skirt 468 and comprises a flat annular edge 452 and a base 451. Openings 453 are disposed in a circle in the connecting zone between the edge 452 and the lateral skirt of the cylindrical cap, the said lateral skirt connecting the base 451 and the edge 452. An annular projection 454 having a diameter smaller than that of the circle carrying the openings 453 is formed under the base 451, i.e. at the side of the bottle 402.

The edge 452 is welded on to the transverse plate 464 so that the annular projection 454 of the elastic membrane 405 is in contact with the interior of the skirt 46 of the capsule and that the openings 453 open into the space situated between the annular projection 454 and the lateral skirt of the elastic membrane 405, the skirt 468 being disposed between the annular projection 454 and the lateral skirt of the membrane 405.

The top cap 404 comprises laterally a cylindrical skirt 442, the lower edge of which comprises a groove 443 cooperating with the outer locking flange 462 of the capsule 406 and the upper edge of which is connected to an upper circular face 441 perpendicular to the axis of the neck 421. The inner wall of the upper face 441 carries, as a means for holding the elastic membrane in the closed position, an annular flange 444 which rests against the elastic membrane over a circle having a diameter slightly less than that of the annular projection 454, so that it can hold the said projection 454 in a sealed manner against the rigid skirt 468.

In order to effect packaging of the product according to this invention, the bottle 402 is filled with the product P, then the capsule 406 provided with its elastic membrane 405 is screwed on to the neck 421 of the bottle 402. As illustrated in schematic form in FIG. 8, a bell 407 is then applied in a sealed manner to the elastic membrane 405 and the air contained in the bottle is aspirated, as indicated by the arrow F1, so as to reduce pressure in the bottle 402. Upon aspiration, by the action of the air emerging through the openings 465 of the capsule 406, the elastic membrane 405 is deformed, inflating, the lateral wall of the cap moving away from the outer wall of the skirt 468. At the same time, the annular projection 454 of the membrane 405 moves away from the skirt 468 of the capsule 406. The openings 453 of the membrane 405 and the openings 465 of the capsule 406 establish communication between the bottle 402 and the bell 407.

The top cap 404 is then fixed to the head 403. The annular flange 444 presses against the elastic membrane 405 and holds the said membrane 405 in the closed position holding the projection 454 against the skirt 468, even when the bottle 402 is once again pressurized. The product contained in the bottle is thus held under reduced pressure during storage and is isolated from the atmosphere.

When the user wishes to remove the product contained in the bottle, he acts upon the top cap 404 which is fixed in rotation with the head 403 by interaction of the serrations 467 and 445 and separates the assembly (cap 404/head 403) from the bottle 402.

It will be seen that in this embodiment the valve formed by the elastic membrane 405 is held in a sealed closed position during storage until the user opens the bottle. However, as far as the user is concerned, it appears that the "plug" of the bottle, formed by the top cap 404 and the head 403, is formed of one single piece.

I claim:

1. Packaging unit for enclosing a product and improving preservation thereof, comprising:

a container having a neck zone, into which the product is entered;

a capsule attached to said neck zone of said container;

a valve associated with said capsule, said valve serving as a means by which pressure is changed in said container; and said valve comprising a flexible elastic membrane having the shaped of a cylindrical cap including an edge and a base, at least one opening being formed in said membrane, wherein said valve can remain closed by virtue of the inherent elasticity of said membrane and can open by the application of an aspiration and/or injection member over said membrane base, wherein a top cap is fixed to said capsule, and covers said capsule and said valve with which it is associated, said capsule having an outer wall and an inner wall with one of said walls having means for preventing rotation of said top cap relative to said capsule.

2. Packaging unit according to claim 1, wherein said valve comprises a relatively thick elastic membrane comprising in its central zone an opening formed by at least one slot having contiguous edges, said membrane being held onto said neck zone via its edges by virtue of said capsule with which it cooperates.

3. Packaging unit according to claim 2, wherein said capsule comprises a membrane support comprising an inner collar, substantially perpendicular to the longitudinal axis of said neck, affixing said elastic membrane to said collar.

4. Packaging unit according to claim 3, wherein said top cap comprises an element capable of reinforcing a seal.

5. Packaging unit according to claim 4, wherein said element capable of reinforcing a seal comprises a projection of said top cap resting against a zone corresponding to said slot opening of said elastic membrane.

6. Packaging unit as claimed in claim 4 wherein said edge of said cylindrical cap forming said elastic membrane is connected to said base via a lateral skirt, said membrane comprising a plurality of openings disposed in the connecting zone between said base and said lateral skirt and at right angles with the end of a rigid skirt integral with said capsule, an annular projection carried by said base resting against the inner face of said rigid skirt, the end of said rigid skirt thereby being gripped between said annular projection and said lateral skirt of said elastic membrane.

7. Packaging unit according to claim 6 wherein between said fixing zone of said capsule to said neck and said end of said rigid skirt there is provided, on the one hand, a perforated plate ensuring both the rigidity of said rigid skirt and the passage of the product to be distributed, and, on the other hand, means ensuring sealing between said capsule and said container.

8. Packaging unit according to claim 6, wherein said top cap comprises a flange situated on an inner wall thereof, said flange resting against said elastic membrane substantially at right angles with said annular projection of the latter and holding said lateral skirt of said elastic membrane against said rigid skirt forming said seat.

* * * * *